United States Patent [19]

Kwan et al.

[11] 3,934,370

[45] Jan. 27, 1976

[54] PANEL OPERATING MECHANISM

[75] Inventors: Gerald A. Kwan, Pasadena; Walter V. Penkov, Glendale; Norman E. Roe, Sierre Madre, all of Calif.

[73] Assignee: Hehr International Inc., Los Angeles, Calif.

[22] Filed: Jan. 21, 1974

[21] Appl. No.: 434,898

[52] U.S. Cl. ..... 49/341; 188/1 B; 49/345

[51] Int. Cl.[2] ..... E05F 11/22

[58] Field of Search ..... 49/324, 326, 339–343, 49/345, 371, 391; 188/67, 83, 1 B

[56] References Cited

UNITED STATES PATENTS

| | | | |
|---|---|---|---|
| 2,230,414 | 2/1941 | Piron | 188/1 B |
| 2,260,403 | 10/1941 | Preston | 49/391 X |
| 2,514,138 | 7/1950 | O'Connor | 188/1 B |
| 2,626,566 | 1/1953 | Pasquinelli | 188/33 X |
| 3,071,219 | 1/1963 | Vuncannon | 49/341 X |
| 3,666,057 | 5/1972 | Leifer et al. | 188/83 X |
| 3,819,014 | 6/1974 | Mortensen | 188/1 B |

*Primary Examiner*—Kenneth Downey
*Attorney, Agent, or Firm*—Reed C. Lawlor

[57] ABSTRACT

A panel in the form of a movable window frame hinged along its upper edge is swung from a closed position to an open position by a mechanism which includes a torque rod and crank-operated self-locking gearing to actuate the torque rod. A vibration damper in the form of a friction pad or brake shoe that engages the torque rod at a distance from the gearing, prevents chattering of the window when it is being swung towards its closed position and also resists any tendency for wind or vibration to oscillate the window.

10 Claims, 10 Drawing Figures

PANEL OPERATING MECHANISM

BACKGROUND OF THE INVENTION

In various arts it is common to adjust the position of a hinged panel, such as a window, by means of a mechanism which includes a torque rod linked to the panel and self-locking gearing for rotating the torque rod.

One shortcoming of such an arrangement for controlling a hinged panel is the tendency of such a hinged panel to chatter as it is being swung downwardly towards its closed position. The chatter of the moving window is caused by a grabbing action which occurs between the torque rod and the bushings in which the ends of the torque rod are mounted.

Another shortcoming involves the fact that environmental forces, such as wind or vibration, acting on the panel may cause the panel, when open, to oscillate or flutter in an annoying manner.

In practice where the invention is applied to a mobile home or other vehicle, users are discouraged from leaving the windows open while the vehicle is traveling on a highway or the like. However, window flutter may occur even when the vehicle is stationary, due to wind blowing on the window or to vibrations of the vehicle.

SUMMARY OF THE INVENTION

The invention resides in the discovery that flutter of such a hinged panel during closing and by environmental forces is attributable to the backlash or lost motion in the gearing that controls the torque rod, and that backlash and lost motion in the hinged mounting of the movable window frame may be completely eliminated or at least greatly reduced by providing a brake shoe or friction pad to establish appropriate yielding resistance to rotation of the torque rod. In effect the brake shoe and associated parts provide a shock absorber to dampen vibration of the hinged window from the backlash of the gearing.

The invention not only serves the purpose of eliminating chatter during the movement of the panel towards closed position but also serves to dampen vibration of the window when the vibration is due to environment forces such as wind or vibration of the vehicle. The window operator of the invention also reduces shock loads otherwise applied to the gearing.

Within the basic concept that underlies the invention, various arrangements may be employed to apply frictional resistance or otherwise dampen oscillatory to rotation of the torque rod. In some embodiments of the invention disclosed herein a brake shoe is employed to subject the tubular wall of a torque rod to radial compression. In others, a brake shoe acts on a radial arm of the torque rod in a direction parallel to the axis of the rod. In another embodiment of the invention the friction member is in a form of a split collar that embraces the torque rod and may be tightened to various degrees.

Various features and advantages of the invention may be understood from the following detailed description and the accompanying drawings.

BRIEF DESCRIPTION OF THE DRAWINGS

In the drawings, which are to be regarded as merely illustrative.

DETAILED DESCRIPTION

Figure 1:
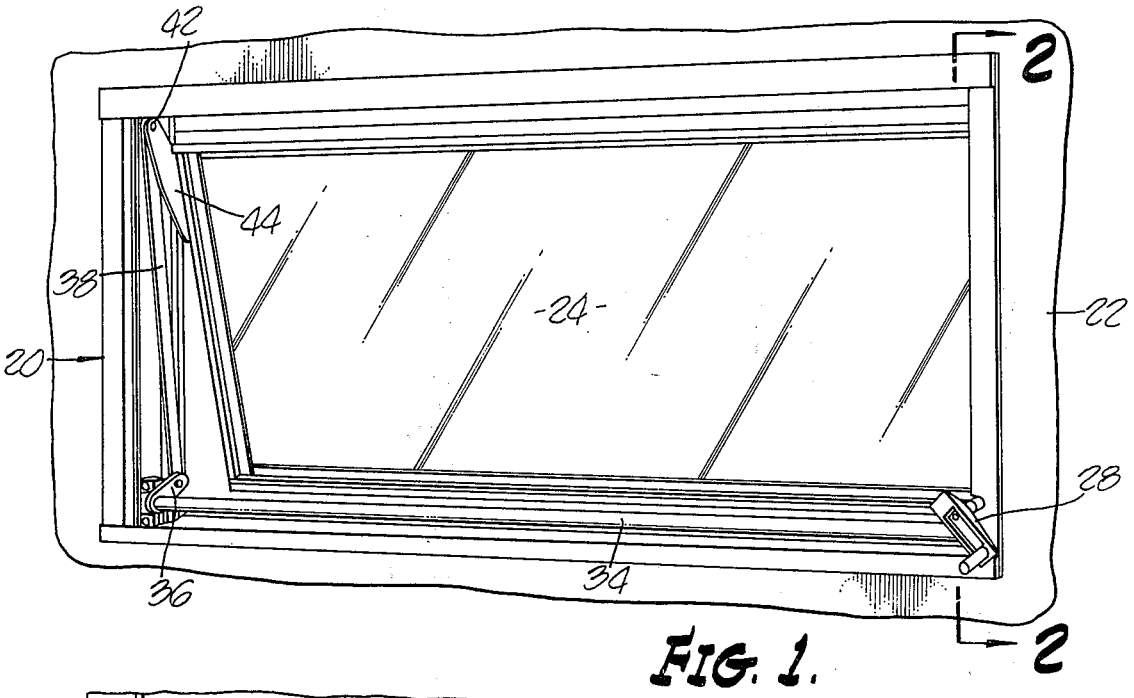
FIG. 1 is a perspective view of a hinged window and the mechanism for moving the window from a closed position through a range of open positions.
Figure 2:
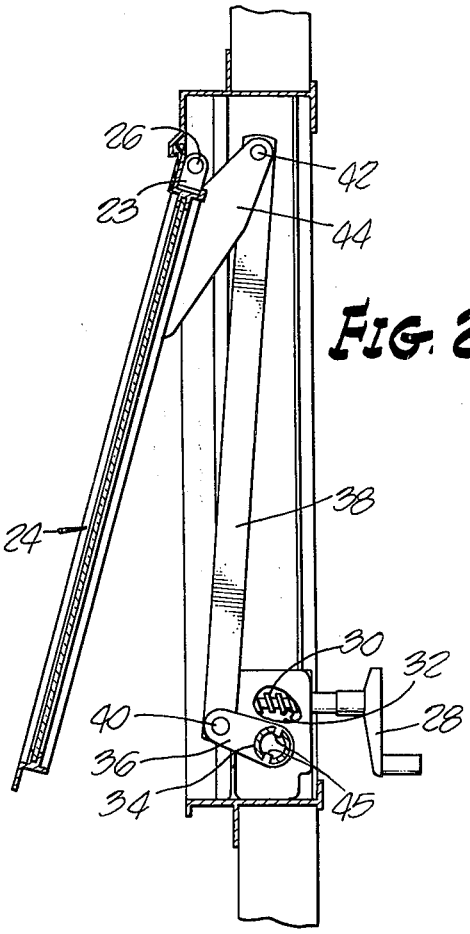
FIG. 2 is a vertical section along the line 2—2 of FIG. 1 showing the linkage that connects the torque rod to the hinged window.

Referring to FIGS. 1 and 2, a stationary window frame, generally designated 20, made of extruded metal and mounted in a side wall 22 of a vehicle such as a recreational vehicle or a mobile home, carries a rectangular window 24 mounted in a movable frame 25 that is hinged along its upper edge. In the construction shown, opposite ends of the movable window frame are provided with upwardly projecting tongues 23 which are mounted on pivots 26 at the opposite sides of the stationary window frame to permit the window to swing outwardly of the wall from a lowered closed position through a range of open positions or from one open position to another or from an open position to a closed position.

In a well known manner, the window is operated manually by means of a window operating mechanism that includes a torque rod, self-locking gearing for rotating the torque rod, a crank for operating the gearing, and a three-bar linkage to translate rotation of the torque rod into reduced rotation of the window. The right end of the torque rod 34 is mounted in a suitable bearing (not shown) at the right side of the window frame 20. The opposite or left end of torque rod 34 is mounted in a bearing, generally designated 35, which will be described in detail hereafter.

In the construction shown, a manually operable crank 28 is unitary with a worm 30 that has a helical thread in sliding contact with the teeth of a worm wheel 32 that is fixedly mounted near the right end of a tubular torque rod 34. Such gearing is self-locking but normally has backlash.

Adjacent the bearing 35, the torque rod 34 carries an arm 36 which is connected to the lower end of an upwardly extending link 38 by a suitable pivot 40. The upper end of the link 38 is connected by a pivot 42 through an arm 44 on the left end of the window 24.

To carry out the purpose of the invention backlash or lost motion between the torque rod 34 and the window 24 is made low. The arm 36 is rigidly mounted on the torque rod 34; the arm 44 is rigidly mounted on the window 24; and the two pivots 40 and 42 fit closely.

In the construction shown, the base end of the arm 36 embraces the torque rod 34 and is formed with a pair of diametrically opposite tapered tongues 45 which extend radially inwardly into two diametrically opposite end slots 46 of the torque rod and fit tightly in those slots. The are 44 is rigidly mounted on the left end of the window 24 by spaced screws (not shown) to assure the required rigidity of the arm. As shown on FIGS. 3 and 4 the pivot 40 for the arm 36 is a pin that is formed with a head flange 48 on one end and that is provided with a circumferential groove on the other end to receive a snap ring 50. The pivot pin 40 fits snugly but rotatably in bores 52 and 54 of arm 36 and link 38 respectively. The upper pivot 42 is of the same snug construction as the lower pivot 40.

In this highly competitive field, the described control mechanism must be manufactured at relatively low cost and it is possible to produce the control mechanism on a mass production basis with little, though some, backlash between the torque rod and the window. Mass production of the worm 30 and the cooperating worm wheel 32 precludes precision on machining and necessitates liberal tolerances in the dimensioning of the helical thread of the worm and in the dimensioning of the teeth of the worm wheel. As a consequence appreciable backlash in the gearing is common and inevitable. And thus there is backlash, both at the driving end of the mechanism, that is at the gearing, and at the driven end, that is at the pivots of the window.

In the construction shown, the effective length of the arm 36, i.e. the distance between the axis of the torque rod 34 and axis of the pivot 40, is approximately 1.45 times the effective diameter of the worm wheel 32 and the distance from the hinge axis of the window to the lower swinging edge of the window is approximately 10 times the effective length of the upper arm 44, i.e. the distance between the axis of the pivot and the axis of the hinge of the window. The offset of the pin 40 from the axis of the torque rod is about the same as the offset of the pin 42 from the axis of the pins 26 about which the window rotates. It is apparent, then, that the lower edge of the window has freedom to flutter through an arc which is about 14.5 (that is 1.45 times 10) times the magnitude of the backlash in the gearing. Thus, even in the absence of lost motion in the window hinge a lost motion of only five mils (0.005 inch) in the gearing could permit the lower edge of the window to flutter through an arc of about 0.075 inch in response to environmental forces such as wind and vibration.

The backlash in a production run of gearing varies widely between a given minimum and a given maximum. For example, suppose each gear of a pair of cooperating gears is dimensioned with a tolerance of plus or minus 0.003 in. At one extreme, the combined tolerance of the randomly selected gears will substantially cancel each other to result in substantially no backlash. At the other extreme, the combined tolerance may be additive resulting in backlash of 0.006 in. Thus, even disregarding backlash in the window hinge, a potential exists for a considerable amount of vibration of the window just due to the backlash in the gearing.

In this invention a friction pad is introduced between the driving end and the driven end of the window operating mechanism thus isolating the window from the backlash of the gearing. This braking mechanism also serves as a damper to resist any vibration that does occur in the window.

Figure 3:
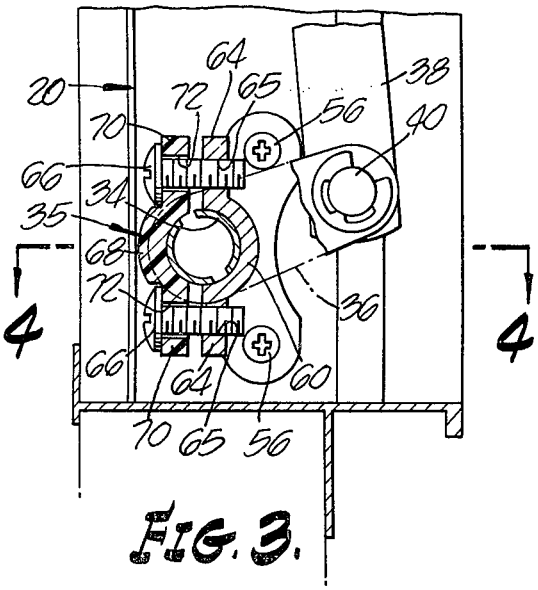
FIG. 3 is a view, partly in side elevation and partly in section, showing how a bearing for one end of the torque rod may incorporate a friction member for creating resistance to oscillatory rotation of the torque rod.
Figure 4:
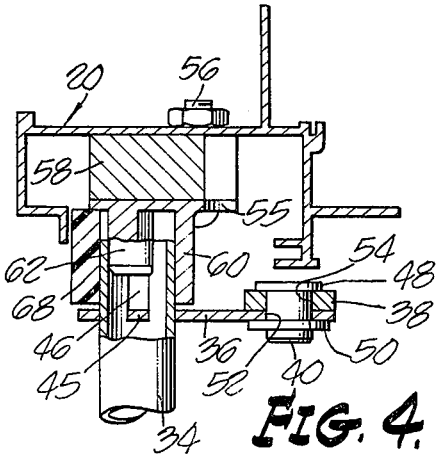
FIG. 4 is a horizontal section taken along the line 4—4 of FIG. 3.
Figure 5:
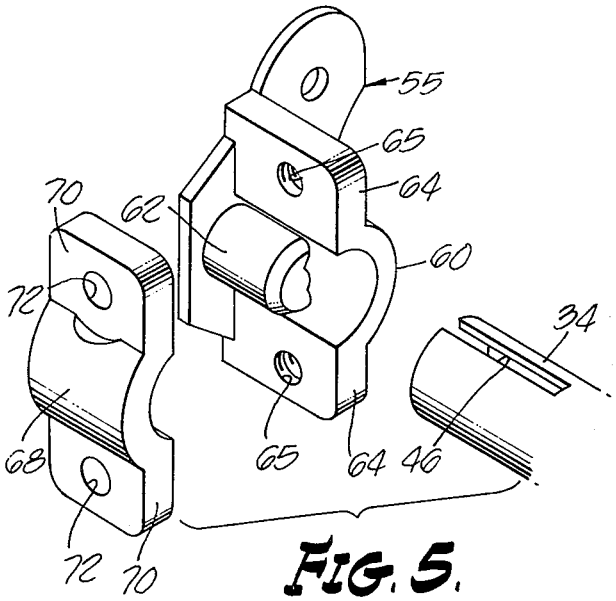
FIG. 5 is an exploded perspective view of the cooperating parts that are shown in FIGS. 3 and 4.

In the first embodiment of the invention shown in FIGS. 1–5, the means for frictionally opposing rotation of the torque rod 34 is incorporated in the end bearing 35. As shown in FIGS. 3, 4 and 5 the first bearing member 55 is fixedly mounted on the window frame by a pair of screws 56 with an intervening spacer block 58 (FIG. 4). This bearing member has a fixed semicylindrical shoe portion 60 that forms one-half of the bearing. The fixed first bearing member 55 also has a boss portion 62 that extends into the end of the tubular torque rod in contact with the inner surface thereof, acting as an axle or pivot pin at a point diametrically opposite from the shoe 68. The stationary shoe portion 60 is formed with two diametrically opposite radial flanges 64 which have threaded bores 65 for screw threaded engagement by corresponding screws 66.

The second half of the bearing 55 is formed by a second shoe 68 which is formed with two external radial flanges 70 that have over-sized bores 72 to receive the screws 66. It is apparent that the screws 66 may be tightened to cause the movable shoe 68 to cooperate with the fixed boss portion 62 to place the end of the tubular torque rod under any desired degree of radial compression to create the desired resistance to rotation or other vibration of the torque rod. The movable shoe 68 may be made of a suitable compliant plastic to provide a desirable coefficient of friction with respect to the surface of the torque tube. Nylon is a suitable plastic for this purpose.

Figure 6:
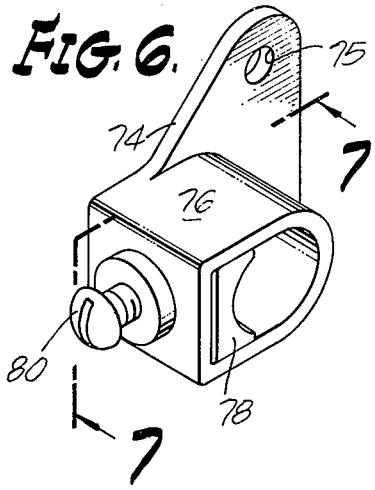
FIG. 6 is a perspective view showing how another type of bearing for one end of the torque rod may incorporate a friction member to create the required resistance to rotation of the torque rod.
Figure 7:
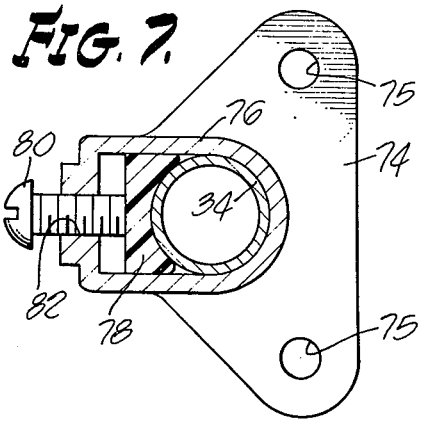
FIG. 7 is a sectional view taken along the line 7—7 of FIG. 6.

In a second embodiment of the invention illustrated by FIGS. 6 and 7, the bearing at the left end of the torque tube includes a fixed member 74 having spaced holes 75 to receive suitable screws (not shown) for attachment to the window frame. The fixed member 74 has an integral stirrup portion 76 which embraces the torque rod 34 and slidingly confines a plastic shoe 78. A screw 80 mounted in a threaded bore 82 of the stirrup may be tightened to urge the shoe 78 against the periphery of the torque tube to provide resistance to rotation of the torque rod.

Figure 8:
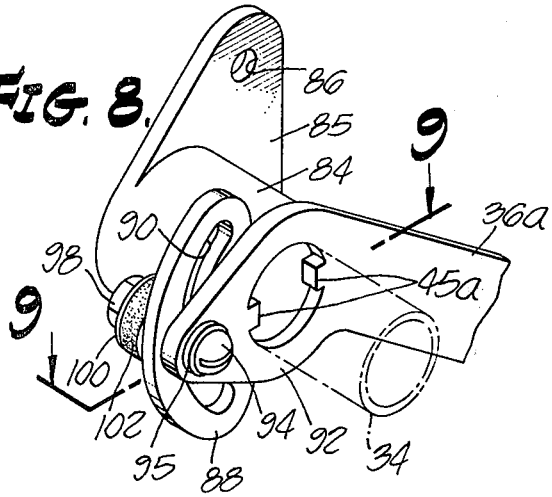
FIG. 8 illustrates another construction for a bearing at one end of the torque rod that provides the required resistance to rotation of the torque rod.
Figure 9:
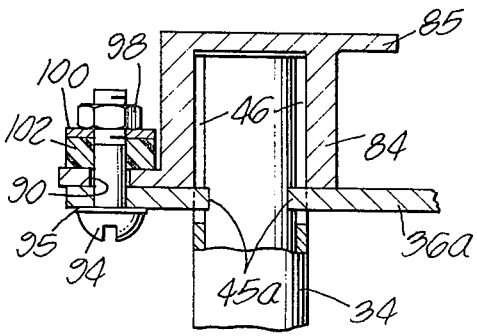
FIG. 9 is a sectional view taken along the line 9—9 of FIG. 8.

In the third embodiment of the invention illustrated by FIGS. 8 and 9, a bushing 84 that serves as a bearing for the left end of the torque rod 34 has a flange 85 with holes 86 therein to receive screws (not shown) for mounting the bushing rigidly on the window frame 20.

The bushing 84 is formed with a fixed radially extending tongue 88 that has an arcuate slot 90 concentric with axis of the bushing 84. The adjacent are **36*a* on the torque rod 34 embraces the torque tube and has the usual pair of radially inward tongues 45*a* to engage a pair of end slots of the tubular torque rod as heretofore explained. The arm 36*a* has an extension 92 in face-to-face relation to the fixed tongue 88. A screw 94 equipped with a washer 95 extends through a bore 96 of the extension 92 and through the arcuate slot 90. The second end of the screw 94 carries a nut 98 and a washer 100 which presses a ring-shaped plastic friction member 102 against the fixed tongue 82 in the region of the arcuate slot 90. It is apparent that the screw 94 may be tightened to any desired degree to provide the required frictional resistance to rotation of the torque rod 34**.

Figure 10:
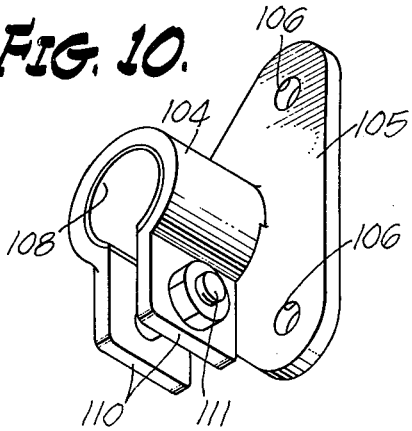
FIG. 10 is a perspective view of a fourth embodiment of a bearing for a torque rod that provides the required resistance to rotation of the torque rod.

In the fourth embodiment of the invention, shown in FIG. 10, the bearing at the left end of the torque tube 34 is in the form of a split collar 104 one-half of which has a flange 105 provided with holes 106 to receive screws (not shown) for attaching the bearing to the frame of the window. The split collar 104 is provided with a plastic friction liner 108 and is formed with two confronting flanges 110 which may be tightened to any desired degree by a screw 111 and nut 112 to provide the desired resistance to rotation of the torque rod.

From the foregoing description, it is apparent that the present invention provides a means for reducing vibration of a hinged pqnel such as a window that is mounted on the external wall of a mobile home. It will, of course, be understood that the various embodiments of the invention that have been described are illustrative only and that the invention may be embodied in many other forms within the scope of the appended claims.

The invention claimed is:

1. an oscillation-resistant movable closure assembly comprising:

an elongated rod mounted for rotation about its axis of elongation;

a closure panel mounted adjacent a supporting frame for movement between predetermined open and closed positions relative to said frame upon rotation of said rod;

an operator mechanism coupled via gearing means to one end of said rod for rotating said rod thereby to effect said movement of said panel, said gearing means having backlash therein which could permit undesired partial movement of said panel, when said rod is operated or when external forces, other than forces exerted by said operator mechanism, are imposed on said panel, and a stationary friction pad in pressure engagement with said rod at a location displaced from said one end of said rod for resisting said undesired partial movement of said panel.

2. The combination of claim 1 wherein said panel is a window hingedly attached to said frame.

3. The combination of claim 1 wherein said friction pad is disposed adjacent the other end of said rod.

4. The combination of claim 3 wherein said other end of said rod is mounted for rotary motion in a bearing, said friction pad comprising a portion of said bearing.

5. The combination of claim 1 including means for adjusting the pressure between said friction pad and said rod.

6. In a mechanism to control a panel hinged about a horizontal axis, which control mechanism comprises actuating gearing and mechanical means operatively connecting the gearing to the panel for effecting movement of said panel about its hinges relative to a stationary mounting structure, the combination therewith of:

damping means connected to said mechanical means in spaced relation to said actuating gearing to yieldingly resist operation of the mechanical means by the gearing and thus insulate the panel from lost motion in the gearing thereby to reduce possible oscillation of the panel;

said damping means comprising first and second parts positioned adjacent to one another, one of said parts being mounted at a fixed position relative to said stationary mounting structure and the other of said parts being mounted for movement in response to operation of said actuating gearing, at least one of said parts being constructed to yielding resist motion thereof relative to the other of said parts whereby oscillatory movement of said panel relative to said stationary mounting structure is damped.

7. The combination set forth in claim 6 in which the movable one of said parts includes a torque rod connected to the gearing;

the other of said parts including a stationary friction member in pressure engagement with the torque rod to resist rotation of the torque rod.

8. The combination as set forth in claim 7 which includes screw threaded means to vary the pressure of the friction member against the torque rod.

9. The combination as set forth in claim 7 in which an anchored stirrup embraces the torque rod and the friction member;

and in which means in screw threaded engagement with the stirrup adjustably urges the friction member against the periphery of the torque rod.

10. The combination as set forth in claim 9 in which the torque rod is a tube and the friction means is arranged to place the tube under radial compression, and which includes:

a first member extending into an end of the tube in contact with the inner circumferential surface of the tube;

a second member radially aligned with the first member in contact with the outer circumferential surface of said portion of the tube; and means effective to urge the two members towards each other.

* * * * *